US007494345B2

(12) United States Patent
Saiki

(10) Patent No.: US 7,494,345 B2
(45) Date of Patent: Feb. 24, 2009

(54) ELECTRONIC DEVICE

(75) Inventor: Jun Saiki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/953,772

(22) Filed: Dec. 10, 2007

(65) Prior Publication Data

US 2008/0139012 A1 Jun. 12, 2008

(30) Foreign Application Priority Data

Dec. 11, 2006 (JP) ..... 2006-332994

(51) Int. Cl.
*H01R 12/00* (2006.01)

(52) U.S. Cl. ..... 439/74; 439/66; 439/570

(58) Field of Classification Search ..... 439/74, 439/570, 66

See application file for complete search history.

(56) References Cited

U.S. PATENT DOCUMENTS 6,832,919 B2 * 12/2004 Ma et al. ..... 439/73

FOREIGN PATENT DOCUMENTS

JP 2006-251241 9/2006

* cited by examiner

*Primary Examiner*—Truc T Nguyen
(74) *Attorney, Agent, or Firm*—Dickinson Wright, PLLC

(57) ABSTRACT

An electronic device has provided therein at least a first circuit board 11 and a second circuit board 12, which are electrically connected together, the device including: a female connector 3 secured to the first circuit board 11 and having an opening; a male connector 2 secured to the second circuit board 12 and inserted into the opening; and a connector reinforcement member 8 provided close to the female connector 3, wherein the connector reinforcement member 8 is brought into contact with the female connector 3, which is about to be distorted by an external force, thereby suppressing distortion of the female connector 3.

14 Claims, 16 Drawing Sheets

ELECTRONIC DEVICE

FIELD OF THE INVENTION

The present invention relates to electronic devices, and more particularly to an electronic device with a connector for connecting a plurality of circuit boards together.

BACKGROUND OF THE INVENTION

Recent years have seen a number of proposals of digital cameras provided with an imaging element, which is a kind of electronic circuit, such as a CCD (charge-coupled device), or a CMOS (complementary metal-oxide semiconductor). The digital camera is configured to receive an optical image by an imaging element, and output it after conversion to an electrical image signal, so that image information is recorded to a memory device, such as a built-in memory device or a removable memory card.

In recent years, such digital cameras have increasingly tended to have an imaging element with a higher pixel count and a more compact size. As the pixel count of the imaging element becomes higher, the file size of the image information to be outputted is increased, and therefore a vast memory region is required as compared to conventional memory regions. In addition, such a vast quantity of information is required to be processed in a short period of time, and therefore the circuit scale has been increasing.

In order to house such a circuit with an increased size within a compact body, circuit board integration has been advanced, resulting in a complex structure. On the other hand, there has been some demand to increase the resistance against external shock. For example, Japanese Laid-Open Patent Publication No. 2006-251241 proposes a means for protecting a liquid crystal display panel from external shock by providing a buffering space surrounding a liquid crystal panel, such that the liquid crystal display panel stays out of direct contact with an exterior housing having received external shock.

FIG. 13 illustrates the external appearance of a digital camera with a plurality of circuit boards connected together via a connector. Provided within a camera body CB are a first circuit board 11 and a second circuit board 12, which are connected together via a connector CO. Such a form of connecting a plurality of circuit boards via a connector is common among digital cameras. Note that although not shown in the present example, in some cases, spacers are provided on the circuit board 11 or 12 in order to keep an exterior housing at a predetermined distance from the circuit board 11 or 12, or keep a predetermined distance between the circuit boards 11 and 12.

FIG. 14A illustrates the configuration of the connector CO. The connector CO is composed of a male connector 2 and a female connector 3. The male connector 2 has a plurality of female metal fittings (not shown) contained at the front side (the bottom side in the figure) of a housing 21. Attached at the back side (the top side in the figure) of the housing 21 are a plurality of electric conductors 22 connected to the metal fittings. The electric conductors 22 are connected by, for example, soldering to wiring formed on the circuit board.

On the other hand, the female connector 3 has a plurality of pins (not shown) disposed at the front side (the top side in the figure) of the housing 31, which are connected to the female metal fittings of the male connector 2. Attached to the back side (the bottom side in the figure) of the female connector 3 are a plurality of electric conductors 32 connected to the pins.

FIG. 14B illustrates the male connector 2 inserted into the female connector 31 viewed from the direction indicated by arrow A in FIG. 14A. This figure shows a cross section of the female connector 3 (the housing 31), and an end surface of the male connector 2. Note that for convenience of drawing, the electric conductors 22 and 32 are simplified. As such, the housing 21 of the male connector 2 is inserted into the female connector 3, so that the female metal fittings of the male connector 2 are appropriately engaged with the pins of the female connector 3 to achieve a reliable electrical connection between the connectors.

FIG. 15 illustrates the two circuit boards 11 and 12 disposed in the camera body CB, which are connected by the connector CO in such a manner as to be appropriately engaged with each other as shown in FIG. 14B. The interior of the camera body CB is partitioned by a frame 4 into a circuit room Rc on the top side and a battery room Rb on the bottom side. Disposed in the circuit room Rc is the connector CO having the male connector 2 inserted into the female connector 3, while disposed in the battery room Rb is a battery 7.

The frame 4 is enclosed in the exterior housing (an external cover 5 and a battery lid 6). The external cover 5 is secured to the frame 4. Furthermore, the battery lid 6 is detachably attached to the external cover 5.

The female connector 3 is disposed on the first circuit board 11, and the male connector 2 is disposed on the second circuit board 12. The first circuit board 11 is electrically and mechanically connected to the second circuit board 12 by the male connector 2 inserted into the female connector 3.

In the case of electronic devices such as digital cameras, it is common that a plurality of circuit boards are connected together by a connector, and contained in an exterior housing so as to keep a predetermined distance from the exterior housing, as described above. When a strong external force or shock is applied to the camera body thus configured, the exterior housing might be distorted, and in some cases, the distortion might be more than expected. In such cases, the distorted exterior housing is brought into contact with the circuit board, so that the strong force is directly transmitted to the circuit board.

FIG. 16 illustrates an example where an external force is transmitted to the circuit boards from the exterior housing distorted by the external force in the camera body CB as shown in FIG. 15. In FIG. 16, the exterior housing (in this figure, the battery lid 6) is first distorted by the external force applied in the direction indicated by arrow F (hereinafter, referred to as the "direction F"). Then, the battery lid 6 is distorted and brought into contact with the frame 4, thereby distorting the frame 4. As the frame 4 is distorted, it is brought into contact with an end of the second circuit board 12, so that the external force tends to cause the second circuit board 12 to move in the direction F.

The external force, which has been applied to the second circuit board 12 by the frame 4, is transmitted to the first circuit board 11 via the connector CO (the male connector 2 and the female connector 3). Since the first circuit board 11 is secured to the frame 4, it resists the external force, and makes no movement. However, the second circuit board 12 is not secured to either the frame 4 or the exterior housing, and therefore cannot resist the external force, so that it tends to move in the direction F. Also, the male connector 2 tends to move in the direction F, along with the secured second circuit board 12.

On the other hand, the female connector 3, along with the secured first circuit board 11, tends to maintain its position by resisting the external force. Specifically, stresses acting in opposite directions are generated in the male connector 2 and the female connector 3 of the connector CO that connects the first circuit board 11 and the second circuit board 12 together. Among the first circuit board 11, the second circuit board 12, and the connector CO (the male connector 2 and the female connector 3), the female connector 3 has the weakest mechanical strength, and therefore its housing 31 is distorted or broken at a portion 31*d* failing to resist the external force. As a result of the distortion or breakage of the housing 31, the male connector 2 secured to the second circuit board 12 moves relative to the female connector 3 in the direction F. On the other hand, a gap G is created between the female connector 3 and a portion 31*c* of the housing that is opposite to the distorted portion 31*d* when viewed in the direction F.

Thus, the relative position between the male connector 2 and the female connector 3 is changed, and the pins in the female connector 3 are displaced. Specifically, the female metal fittings of the male connector 2 are disengaged from the pins of the female connector 3. Furthermore, the female connector 3 cannot stably hold the male connector 2 due to the distorted/broken portion 31*d* and the gapped portion 31*c* of the housing 31.

The foregoing has been described by taking as an example the problem that occurs to the circuit boards housed in the camera body CB after the camera is completely assembled as an electronic device. However, such a problem where the connection of the connector CO is damaged by a force applied to the circuit boards might be caused in the course of connecting the circuit boards at factories or suchlike. For example, workers have to join the first board 11 and the second board 12 together under the situations where the connection between the male connector 2 and the female connector 3 cannot be directly viewed. Specifically, the workers have to work relying on their own experience and instinct, and when an unnecessary force is applied to the connector CO during assembly of the camera body CB, so that the male connector 2 is displaced with respect to the female connector 3, if they attempt to join the first circuit board 11 and the second circuit board 12 together, the problem as described above might be caused. The same can be said of even the case of production equipment or suchlike, which is used to replace the workers.

BRIEF SUMMARY OF THE INVENTION

An object of the present invention is to provide an electronic device including a plurality of circuit boards connected together by a connector, in which the connection between the circuit boards by the connector is maintained even if an undesirable force is applied to the connector.

To attain the above object, the electronic device according to the present invention has provided therein at least a first circuit board and a second circuit board, which are electrically connected together, the device comprising:

a female connector secured to the first circuit board and having an opening;

a male connector secured to the second circuit board and inserted into the opening; and a connector reinforcement member provided close to the female connector, wherein the connector reinforcement member is brought into contact with the female connector, which is about to be distorted by an external force, thereby suppressing distortion of the female connector.

In the electronic device according to the present invention, the connectors for connecting the circuit boards provided in the device are protected from any unnecessary force, so that the connectors can stably connect the circuit boards together.

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

Before describing embodiments of the present invention in detail, an electronic device according to the present invention will be described in terms of its characteristics.

The present invention has been made based on the assumption that the above-described defective connection by the connector in the conventional electronic device is caused due to excessive distortion of the connector to which an undesirable force have been applied. Therefore, the electronic device according to the present invention includes a nonconventional member (hereinafter, referred to as a "connector reinforcement member") for reinforcing the connector by resisting the unnecessary force, so that the connector is not excessively distorted or broken by the unnecessary force. The following descriptions will focus on the connector reinforcement member taking as an example a digital camera as described in relation to the conventional art.

First Embodiment

Referring to FIGS. 1, 2, 3, 4, 5, 6, 7, 8, and 9, an electronic device according to a first embodiment of the present invention will be described by taking a digital camera as an example. In the present embodiment, a connector reinforcement member 8*a* is provided around a female connector 3 in order to prevent the female connector 3 from being excessively distorted by an undesirable force.

Figure 1:
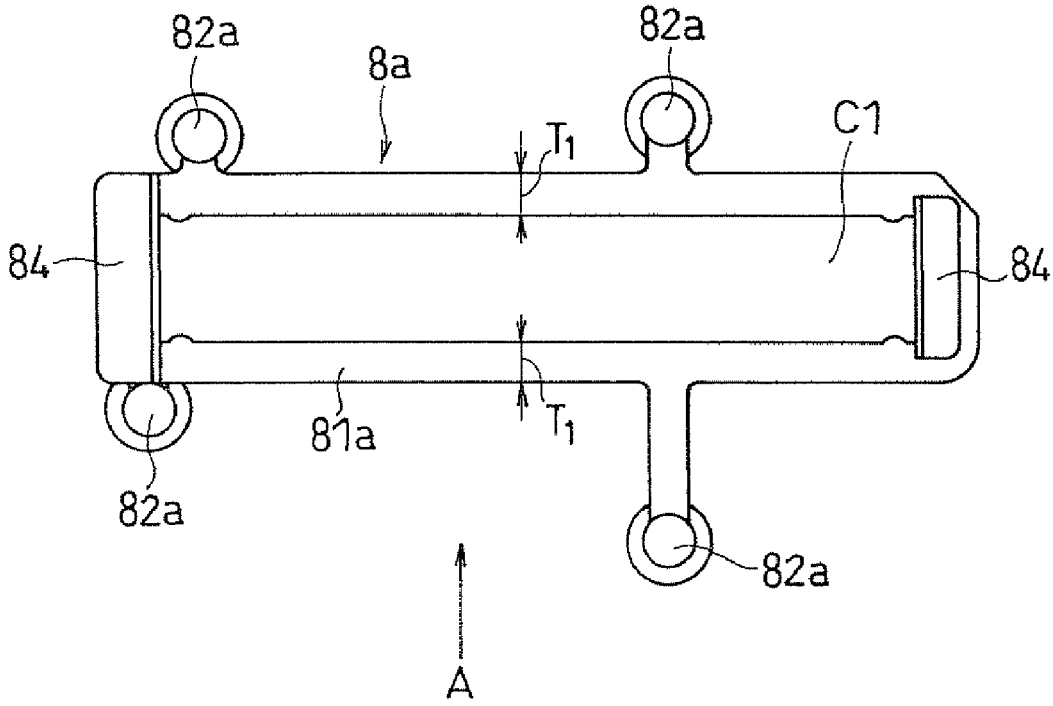
FIG. 1 is a plan view illustrating the configuration of a connector reinforcement member for use in an electronic device according to a first embodiment of the present invention.

FIG. 1 illustrates a plan view of the connector reinforcement member 8*a*. The connector reinforcement member 8*a* is normally made up of a resin material, and includes a frame portion 81*a*, spacers 82*a*, and guiding portions 84. The frame portion 81*a* is formed of a rod-like material into an elongated rectangular ring shape with a central hollow portion Cl in which to fit a housing 31 of the female connector 3.

The hollow portion C1 is formed by prismatic portions, each having a rectangular cross section defined by, for example, width $T_1$×length $T_2$ (FIG. 3), and the shape of the hollow portion C1 is roughly analogous to the outer shape of the housing 31. In the longitudinal direction of the frame portion 81*a* having an elongated rectangular ring shape, the guiding portions 84 are provided so as to partially cover the hollow portion C1 at opposite ends on the top side of the frame portion 81*a*. Two spacers 82*a* are provided on each longitudinal side of the frame portion 81*a*.

In the present example, three of the four spacers 82*a* are provided on the frame portion 81*a*, but the remaining one spacer 82*a* is spaced apart from the frame portion 81*a* in a width direction perpendicular to the longitudinal direction. The spacers 82*a* are originally intended to keep a distance between a first circuit board 11 and a second circuit board 12. However, in the present embodiment, the spacers 82*a* also serve to align the connector reinforcement member 8*a* with the first circuit board 11, as well as the second circuit board 12. This will be described later with reference to FIG. 3.

Figure 2:
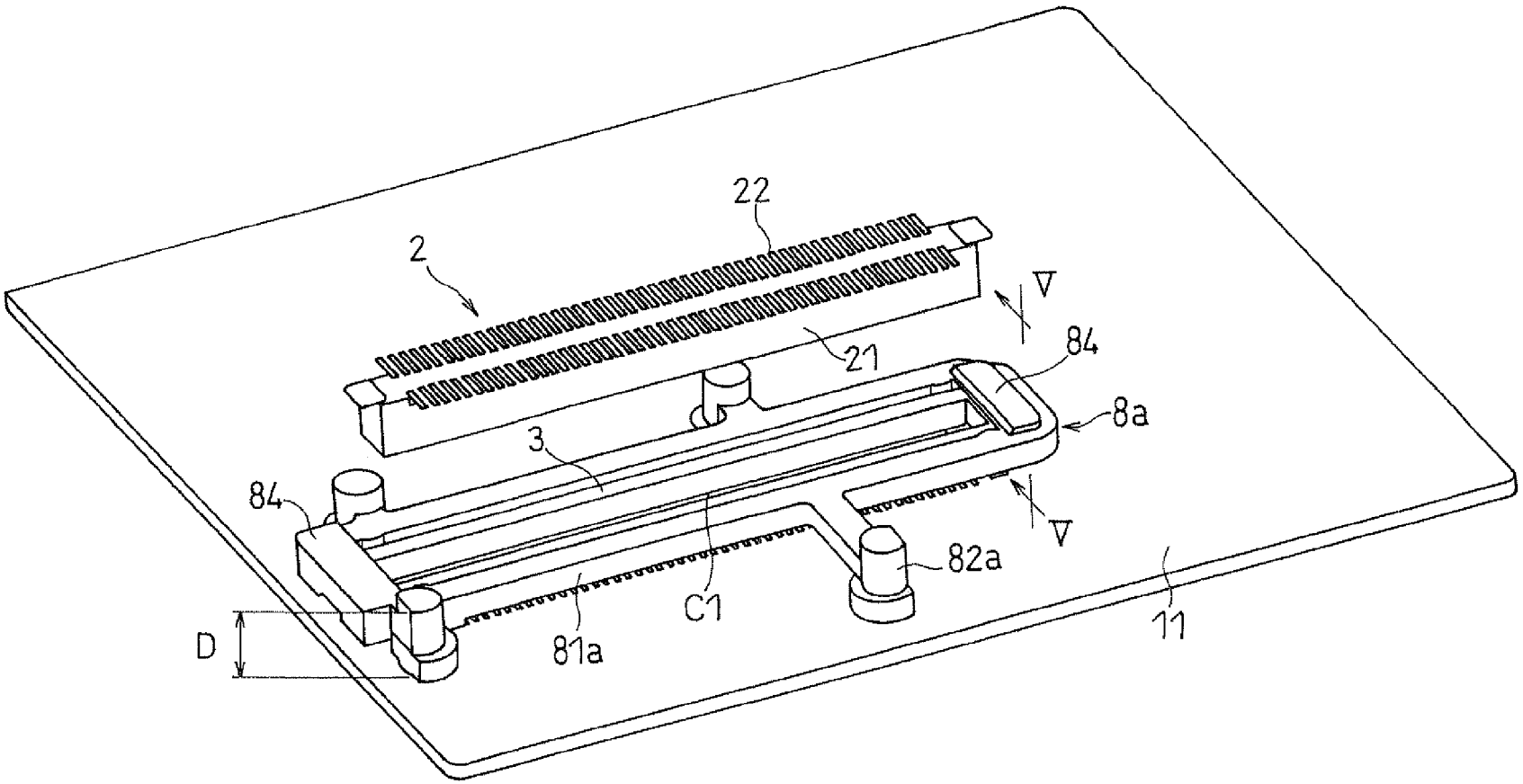
FIG. 2 is a perspective view illustrating configurations of connectors in the first embodiment.
Figure 14B:
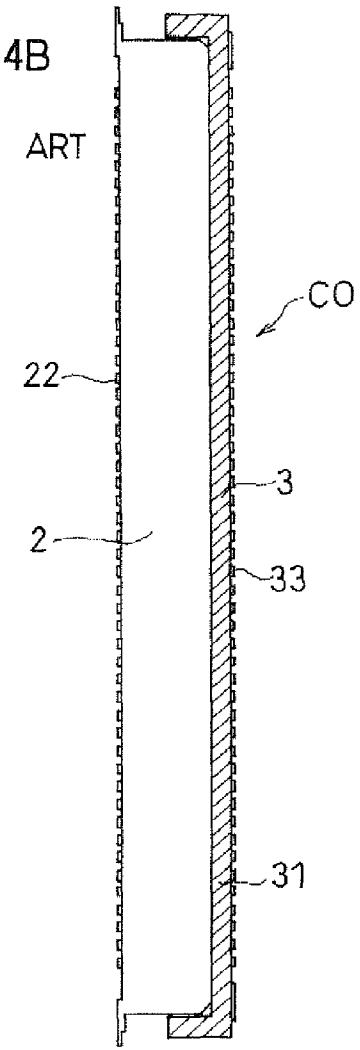
FIG. 14B PRIOR ART
FIG. 14B is a view schematically illustrating the configurations of the connectors in cross section.
Figure 14A:
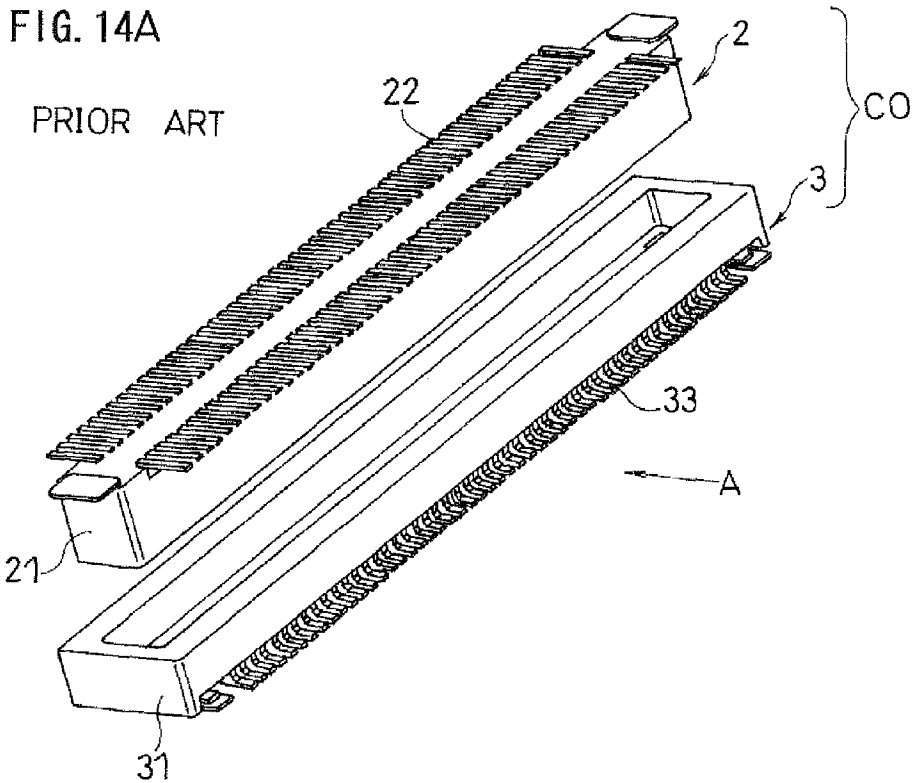
FIG. 14A PRIOR ART
FIG. 14A is a perspective view illustrating configurations of connectors.

As shown in FIG. 2, the connector reinforcement member 8*a* is mounted on the first circuit board 11, with the housing 31 of the female connector 3 being fitted in the hollow portion C1. In this state, the male connector 2 attached to the second circuit board 12 (not shown) is inserted into the female connector 3, as described earlier with reference to FIG. 14. Therefore, the hollow portion C1 defined by the frame portion 81*a* is preferably formed in a slightly large size to such an extent as to facilitate the fitting of the female connector 8*a* into the hollow portion C1. However, if the size is excessively large, when the housing 31 is distorted, the function of preventing the housing 31 from being excessively distorted is rendered less effective. On the other hand, an excessively small size makes it difficult to attach the connector reinforcement member 8*a* to the female connector 3, as well as to insert the male connector 2 into the female connector 3.

Figure 3:
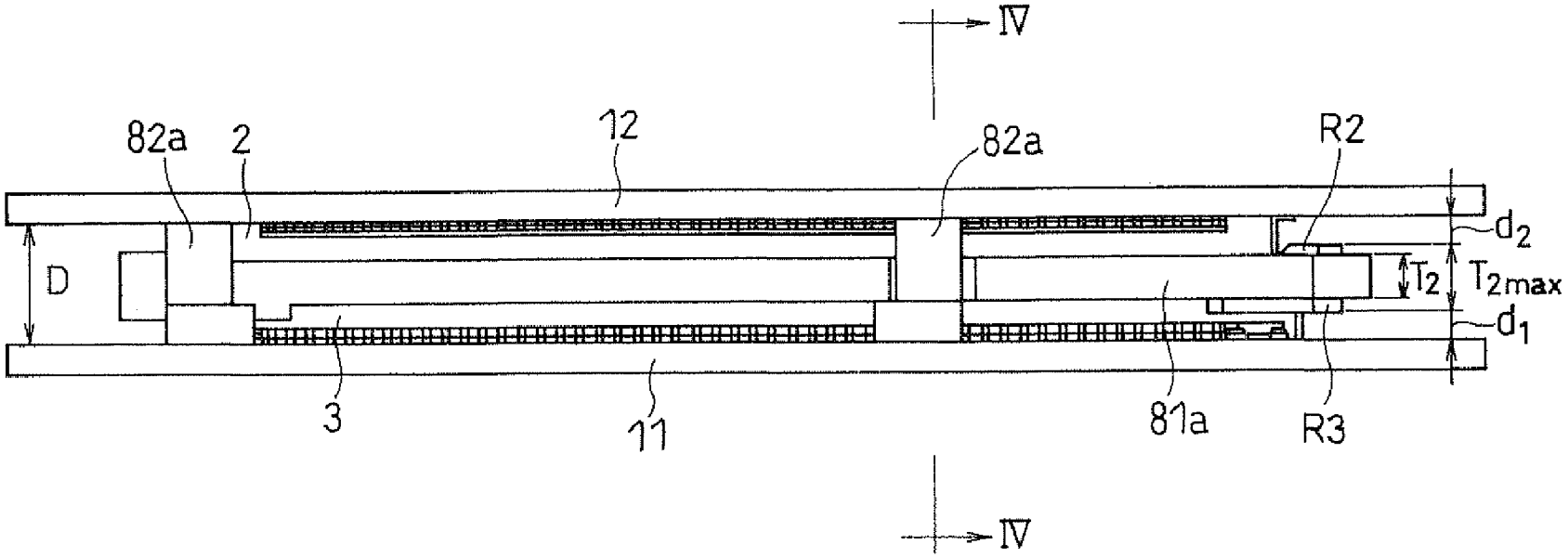
FIG. 3 is a side view illustrating the connection between two circuit boards in the first embodiment.

FIG. 3 illustrates a connector CO viewed from the direction indicated by arrow A in FIG. 1, in which the male connector 2 is inserted into the female connector 3 having the connector reinforcement member 8*a* attached thereto. When the male connector 2 is appropriately inserted into the female connector 3, the space between the first circuit board 11 and the second circuit board 12 is maintained at a predetermined distance D by the spacers 82*a*. At the same time, the space between the frame portion 81*a* of the connector reinforcement member 8*a* and the first circuit board 11, and the space between the frame portion 81*a* and the second circuit board 12 are maintained at predetermined distances $d_1$ and $d_2$, respectively.

As shown in the figure, ribs R2 and R3 are provided at the right end of the connector reinforcement member 8*a* having a thickness of $T_2$. On the other hand, the left end of the connector reinforcement member 8*a* is also shaped to have a thickness of $T_2$ or more. As such, if the maximum thickness (in the present example, the ribs R2 and R3 at the right end are included) of the frame portion 81*a* is $T_{2max}$, the connector reinforcement member 8*a* is held by the spacers 82*a* so as to satisfy the relationship "$D=d_1+T_{2max}+d_2$" with respect to both the first circuit board 11 and the second circuit board 12. The predetermined distances $d_1$ and $d_2$ are set so as to be larger than the thicknesses of the electric conductors 32 and 22, respectively. Note that in the case where such projections and patterns of the electric conductors 32 and 22 are not provided, the predetermined distances $d_1$ and $d_2$ can be set to be equal to the interval between the frame portion 81*a* and the first circuit board 11, and the interval between the frame portion 81*a* and the second circuit board 22, respectively.

Thus, the connector reinforcement member 8*a* is held out of contact with both the electric conductors 22 and 32. By appropriately setting the distances $T_1$ and $T_2$, it becomes possible to prevent excessive distortion or breakage of the female connector 3 when an undesirable force is applied to the connector CO, thereby achieving electrical connection between the first circuit board 11 and the second circuit board 12 via the connector CO. This will be described in detail later with reference to FIG. 8.

In addition, by appropriately setting the distances $d_1$ and $d_2$, it also becomes possible to prevent the frame portion 81*a* from being brought into contact with the circuit boards 11 and 12, thereby damaging the electric conductors 22 and 32, even if an unexpected force is applied to the connector reinforcement member 8*a*. As such, the spacers 82*a* in the present example have both the conventional spacer function of defining the space between the first circuit board 11 and the second circuit board 12, and the function unique to the present invention of reinforcing the connector CO. To achieve these functions, the number of the spacers 82*a*, and their positions are appropriately determined. In addition, instead of allowing the spacers 82*a* to have both functions together, each function may be provided as an individual means.

Figure 4:
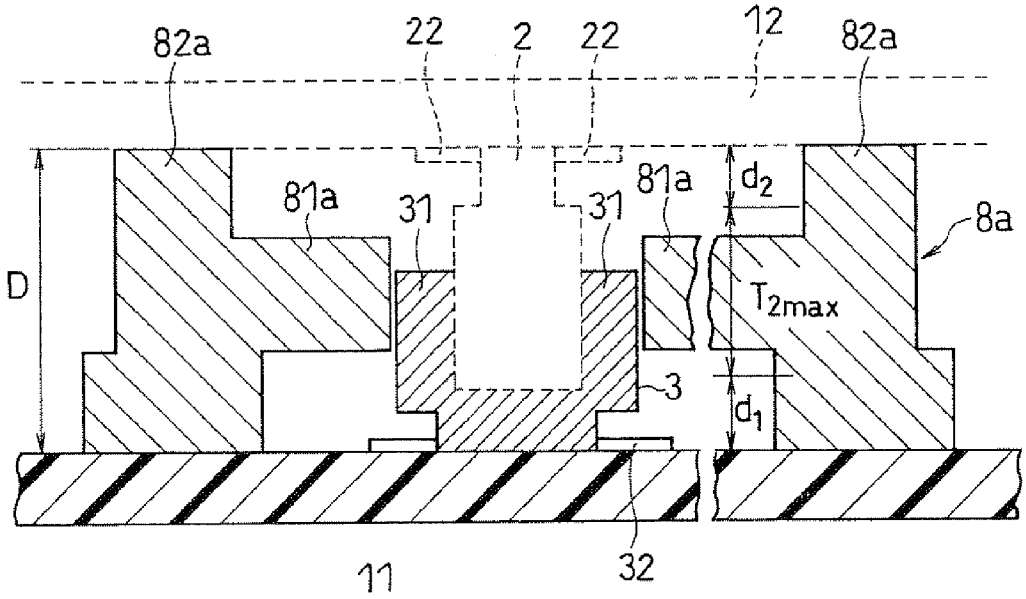
FIG. 4 is a cross-sectional view of a substantial portion taken along line IV-IV in FIG. 3.

FIG. 4 illustrates a substantial portion of the connector CO, including the connector reinforcement member 8*a*, in cross section taken along line IV-IV in FIG. 3 perpendicular to the longitudinal direction of the connector CO. The male connector 2 and the second circuit board 12 are outlined by dotted lines. Pins 34 are provided in the opening of the female connector 3 enclosed by the housing 31 (not shown). Note that the cross section of the actual connector CO differs from that shown in FIG. 4 because the position and shape of the pins vary from one product to another. However, the connector CO is schematically shown for the purpose of describing the relationship between the connector CO and the connector reinforcement member 8*a* in the present invention.

The male connector 2 and the second circuit board 12 are outlined by dotted lines. It can be appreciated from the figure that the first circuit board 11 and the second circuit board 12 are spaced apart at a predetermined distance D by the spacers 82*a*, and the frame portion 81*a* is spaced apart from the first circuit board 11 and the second circuit board 12, respectively by the predetermined distances $d_1$ and $d_2$, so that the frame portion 81*a* is held out of contact with the electric conductors 32 and 22, so as to surround the housing 31 of the female connector 3.

Figure 5:
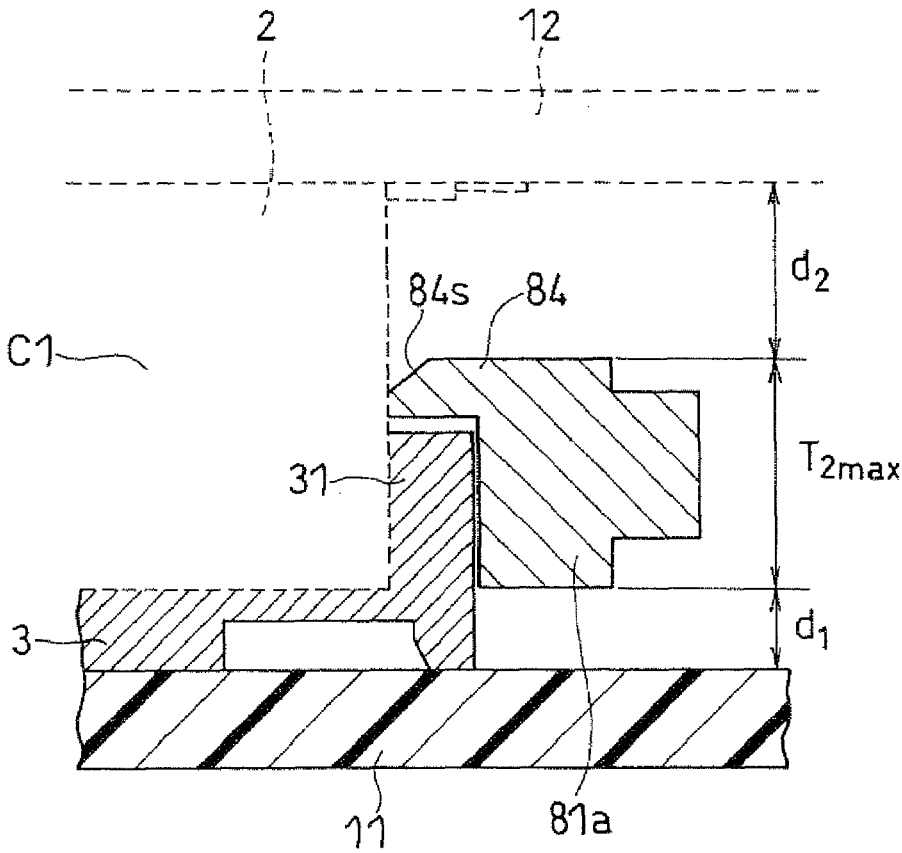
FIG. 5 is a cross-sectional view of a substantial portion taken along line V-V in FIG. 2.

FIG. 5 illustrates a substantial portion of the connector CO, including a longitudinal end of the connector reinforcement member 8*a*, in cross section taken along line V-V in FIG. 2 perpendicular to the width direction of the connector reinforcement member 8*a*. The male connector 2 and the second circuit board 12 are outlined by dotted lines. The guiding portion 84 is integrally formed with the frame portion 81*a*, and positioned on the short side thereof, so as to have a shape to partially cover the housing 31 when the connector reinforcement member 8*a* is attached to the female connector 3.

Formed on the hollow portion C1 side at the upper end of the guiding portion 84 is a slope portion 84*s* inclined toward the longitudinal direction (the hollow portion C1) of the connector reinforcement member 8*a*. When connecting the first circuit board 11 and the second circuit board 12 via the connector CO, the slope portion 84*s* serves to guide the housing 21 of the male connector 2 into the housing 31 of the female connector 3. Concretely, when the male connector 2 is not appropriately positioned with respect to the female connector 3, without the guiding portion 84, the housing 21 might be brought into unnecessary contact with, for example, the rim of the housing 31, and forced into the housing 31, so that the housing 31 is excessively distorted or broken.

The position of the housing 21 (the male connector 2), particularly in the longitudinal direction, is corrected by the slope portion 84*s* (the guiding portion 84), so that the housing 21 is inserted into the housing 31 with the appropriate position. Accordingly, the connector CO (mainly, the female connector 3) is protected from excessive distortion/breakage due to an undesirable force. Thus, the circuit boards can be readily aligned during assembly, making it possible to achieve the effect of reducing the number of man-hours.

Figure 6:
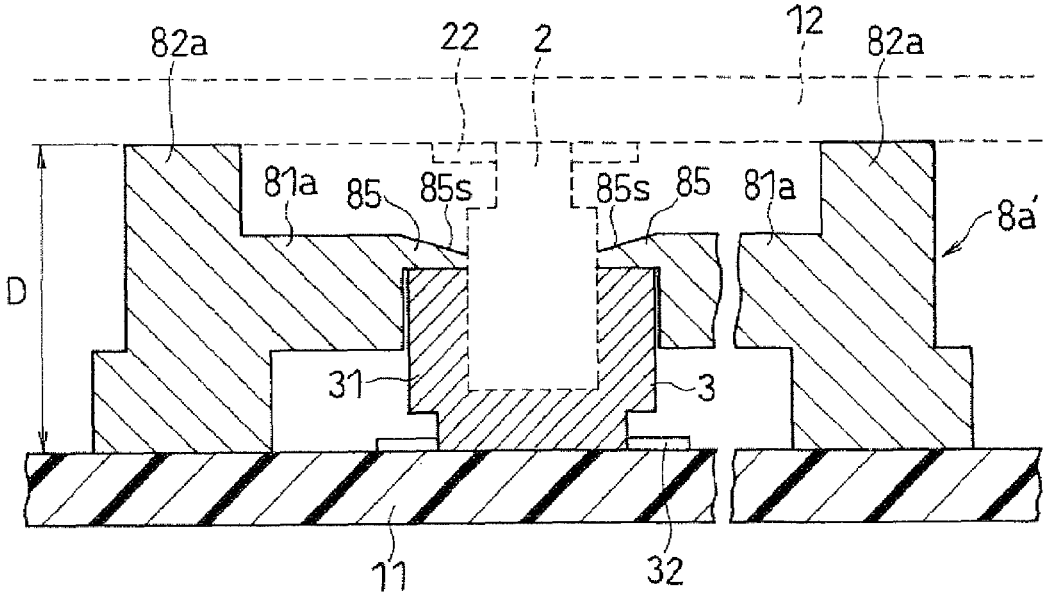
FIG. 6 is a cross-sectional view illustrating a variant of the connector reinforcement member.

A variant of the connector reinforcement member 8*a* will now be described with reference to FIG. 6. FIG. 6 is a cross-sectional view similar to FIG. 4, schematically illustrating a long side of a connector reinforcement member 8*a*' in the present variant. Note that in this figure also, the male connector 2 and the second circuit board 12 are outlined by dotted lines. The connector reinforcement member 8*a*' differs from the connector reinforcement member 8*a* (FIG. 5), in that the guiding portions 84 are replaced by guiding portions 85, each being integrally formed with the connector reinforcement member 8*a*', and positioned on a corresponding one of the long sides of the connector reinforcement member 8*a*'. Furthermore, formed on the hollow portion C1 side at the upper end of each guiding portion 85 is a slope portion 85*s* inclined toward the width direction (the hollow portion C1) of the connector reinforcement member 8*a*'. The slope portion 85*s* guides the housing 21, which is inappropriately positioned, particularly in the width direction, into the housing 31 (the hollow portion C1), thereby preventing excessive distortion/breakage of the female connector 3.

Note that in the present example, no gap is created between the guiding portion 85 and the housing 31, and in view of this, the spacers 82*a*, which are intended to form a gap and maintain the predetermined distances $d_1$ and $d_2$, are not required. However, as described above, the gap can be formed as necessary by providing the spacers 82*a*.

In the above example, the guiding portions 84 are provided so as to extend between the two short sides of the connector reinforcement member 8*a*. However, a single guiding portion 84 may be provided on either of the two sides of the connector reinforcement member 8*a*. Alternatively, the guiding portion 84 may be locally provided in several places, rather than extending between the short sides of the connector reinforcement member 8*a*. The same is applicable to the guiding portions 85. In addition, the guiding portions 84 and the guiding portions 85 may be simultaneously provided on the short and long sides, respectively.

Figure 7:
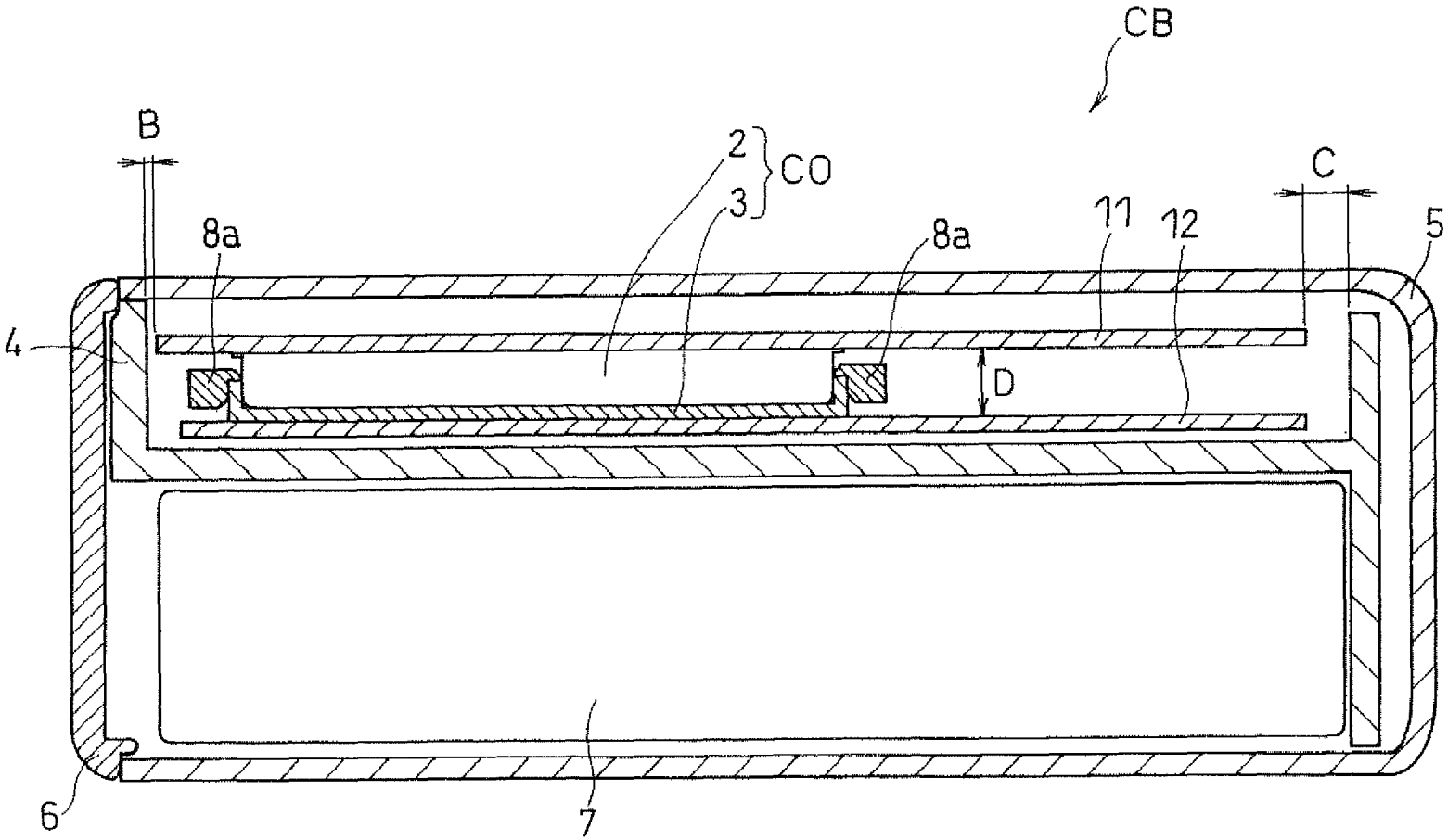
FIG. 7 is a schematic cross-sectional view of a digital camera having the circuit boards provided therein.
Figure 15:
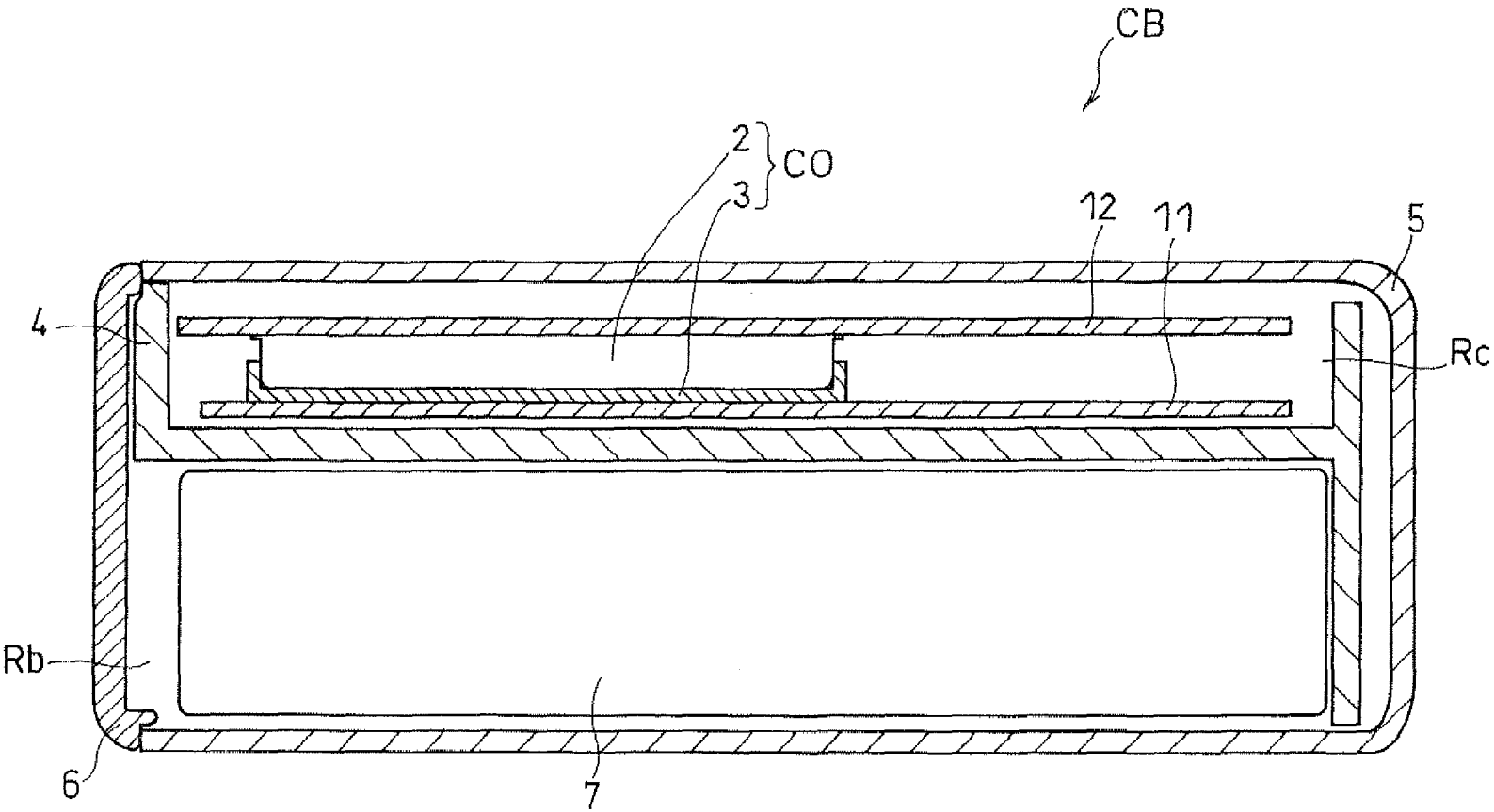
FIG. 15 PRIOR ART
FIG. 15 is a schematic cross-sectional view of a digital camera having conventional circuit boards provided therein.

FIG. 7 illustrates in cross section a digital camera including the first circuit board 11 and the second circuit board 12, which are connected together by the connector CO provided with the above-described connector reinforcement member 8*a*. As in the conventional digital camera shown in FIG. 15, the two circuit boards 11 and 12, which are connected together by the male connector 2 and the female connector 3, are disposed within the camera body CB. It can be appreciated from the figure that the first circuit board 11 and the second circuit board 12 are held at a predetermined distance D by the spacers 82*a* (not shown), and connected together by the male connector 2, which is guided by the slope portions 84*s*, and the female connector 3, which has the connector reinforcement member 8*a* attached around the housing 31, such that the connector reinforcement member 8*a* is out of contact with the electric conductors 32 and 22.

Figure 8:
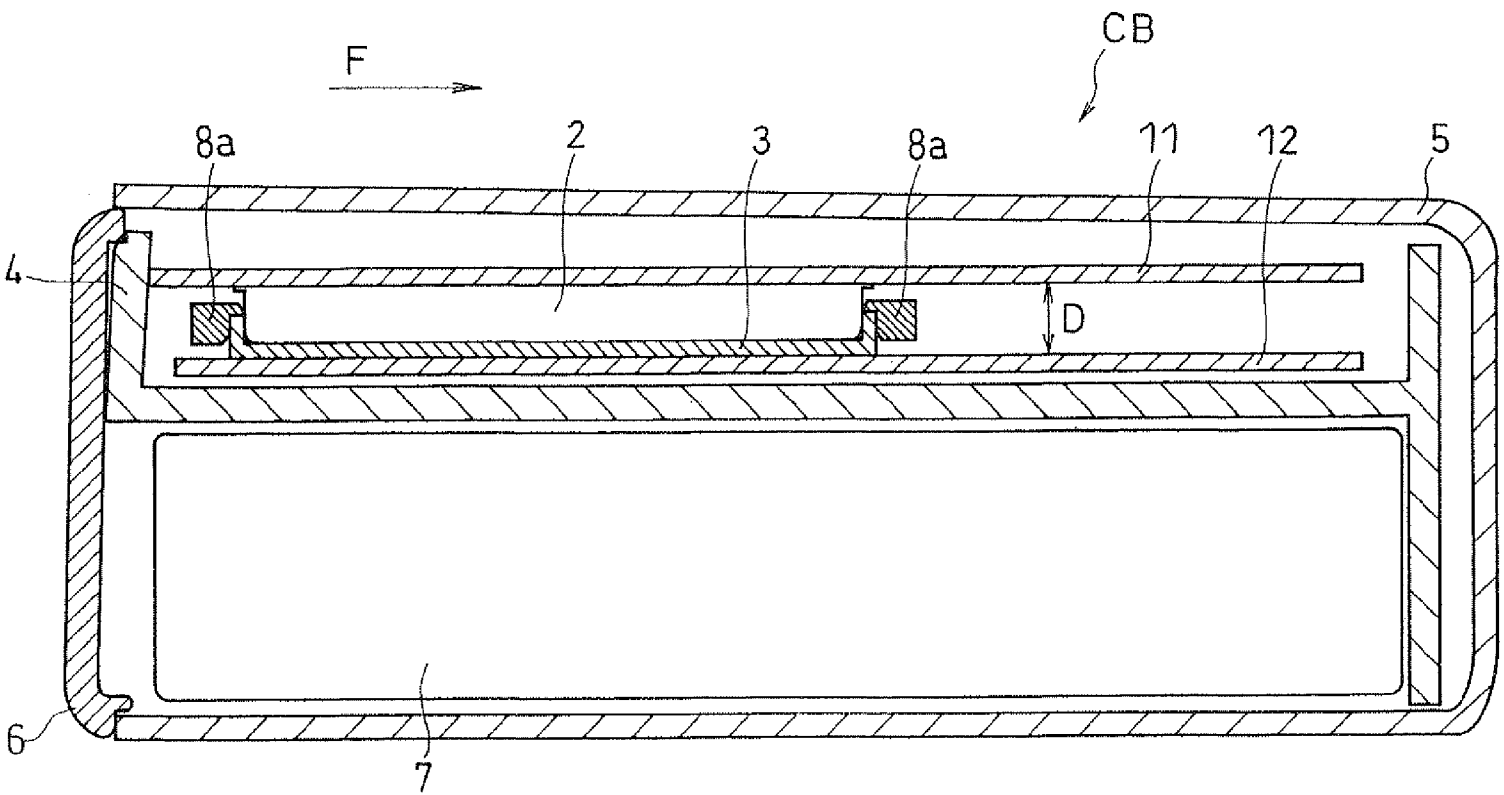
FIG. 8 is a schematic cross-sectional view illustrating the circuit boards to which an external force has been transmitted.
Figure 16:
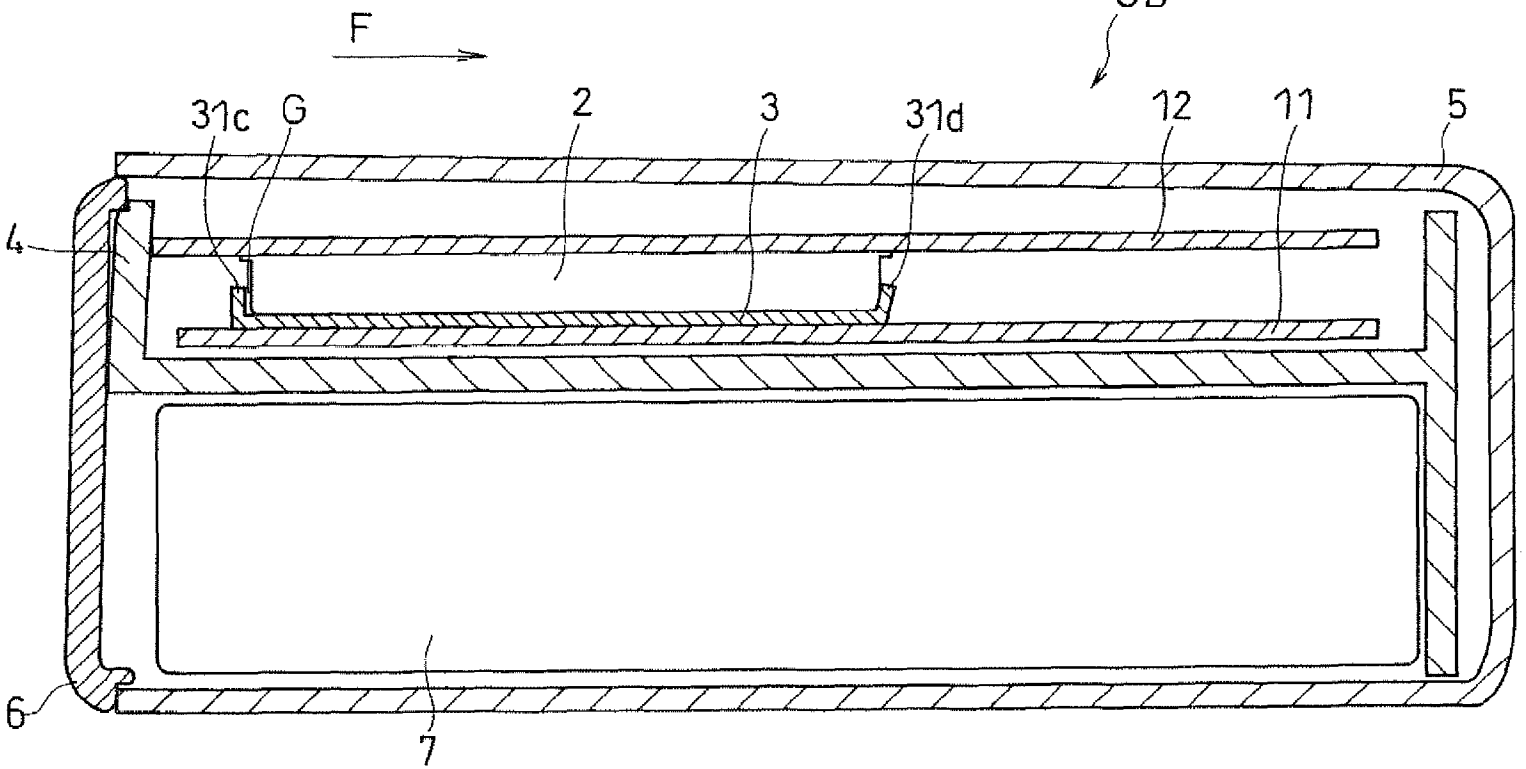
FIG. 16 PRIOR ART
FIG. 16 is a schematic cross-sectional view illustrating the conventional circuit boards to which an external force has been transmitted.

Referring next to FIG. 8, the function of the connector reinforcement member 8*a* in the case where an external force is applied to the camera body CB shown in FIG. 7 will be described in comparison to the above-described conventional example shown in FIG. 16. The example shown in FIG. 8 is the same as the conventional example (FIG. 16) up to the point where an external force applied in the direction F distorts the exterior housing (the battery lid 6), and the frame 4 in this order, and urges the second circuit board 12 to move in the direction F, so that opposing stresses are generated in the male connector 2 and the female connector 3 of the connector CO. However, in the conventional example, there is no means provided for preventing the housing 31 (the female connector 3) from being distorted in the direction F by resisting the external force, resulting in excessive distortion/breakage of the housing 31.

However, in the present embodiment, the connector reinforcement member 8*a* attached around the housing 31 applies its tension against the external force, thereby preventing the housing 31 from being excessively distorted in the direction F. In this sense, it can be said that the connector reinforcement member 8*a* reinforces the strength of the housing 31. Thus, unlike in the conventional example, it is possible to suppress relative movement of the male connector 2 in the direction F, as well as to suppress displacement of the male connector 2 from the female connector 3.

Specifically, when the exterior housing (the battery lid 6) and the frame 4 are distorted within the range of their elastic limits, if the external force vanishes, the connector reinforcement member 8*a* allows the first circuit board 11, the second circuit board 12, and the connector CO to return to their original states as before application of the external force. In addition, even if the exterior housing (the battery lid 6) and the frame 4 experience plastic distortion, the connector reinforcement member 8*a* maintains the electrical connection between the first circuit board 11 and the second circuit board 12 via the connector CO (the male connector 2 and the female connector 3).

As a result, displacement of the pins in the female connector 3 is suppressed, regardless of the presence or absence of any positional change of the male connector 2 relative to the female connector 3. Specifically, engagement of the female metal fittings of the male connector 2 with the pins of the female connector 3 is maintained. Furthermore, the tension applied by the connector reinforcement member 8*a* makes it possible to stably hold the male connector 2 with the housing 31 of the female connector 3.

Figure 9:
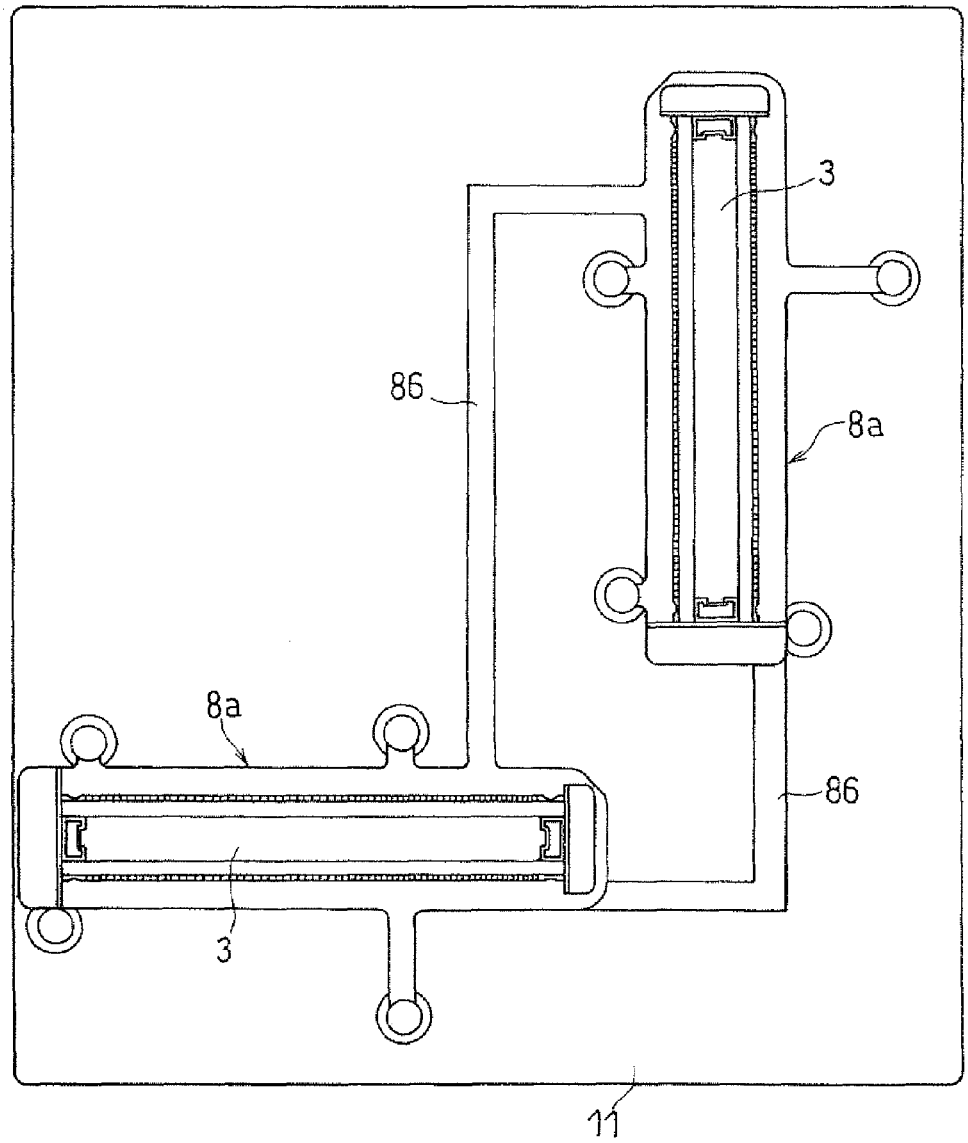
FIG. 9 is a plan view illustrating another variant of the connector reinforcement member.

FIG. 9 illustrates another variant of the connector reinforcement member 8*a* in the present embodiment. When a plurality of sets of connectors are attached to the circuit boards, the reinforcement member can be a connector reinforcement structure as shown in FIG. 9, which is formed by using arms 86 to integrally join two connector reinforcement members 8*a* as employed in the present embodiment. Use of such a connector reinforcement structure further facilitates the process of assembly.

Note that in embodiments of the present invention, the first circuit board 11 and the second circuit board 12 do not always have to be secured to the frame 4, and they may be secured to the external cover 5. In addition, only one of the circuit boards 11 and 12 may be secured to the frame 4 or the external cover 5.

Second Embodiment

A connector reinforcement member included in an electronic device according to a second embodiment of the present invention will be described with reference to FIGS. 10 and 11. As described above, the connector reinforcement member 8*a* in the first embodiment is disposed so as to surround the female connector 3 and stay out of contact with the circuit board 11. On the other hand, a reinforcement member 8*b* in the present embodiment is disposed so as to surround a portion of the female connector 3, and secured to the circuit board 11.

Specifically, the connector reinforcement member 8*a* takes advantage of a constriction force (i.e., tension) of the frame portion 81*a* to prevent the housing 31 of the female connector 3 from being excessively distorted, while the reinforcement member 8*b* takes advantage of a reactive force of the circuit board 11 to prevent the housing 31 of the female connector 3 from being distorted. FIG. 10 illustrates a plan view of the connector reinforcement member 8*b* provided on the circuit board 11, and FIG. 11 illustrates a cross section taken along line XI-XI in FIG. 10. Note that in FIG. 11 also, the male connector 2 and the second circuit board 12 are outlined by dotted lines.

Figure 10:
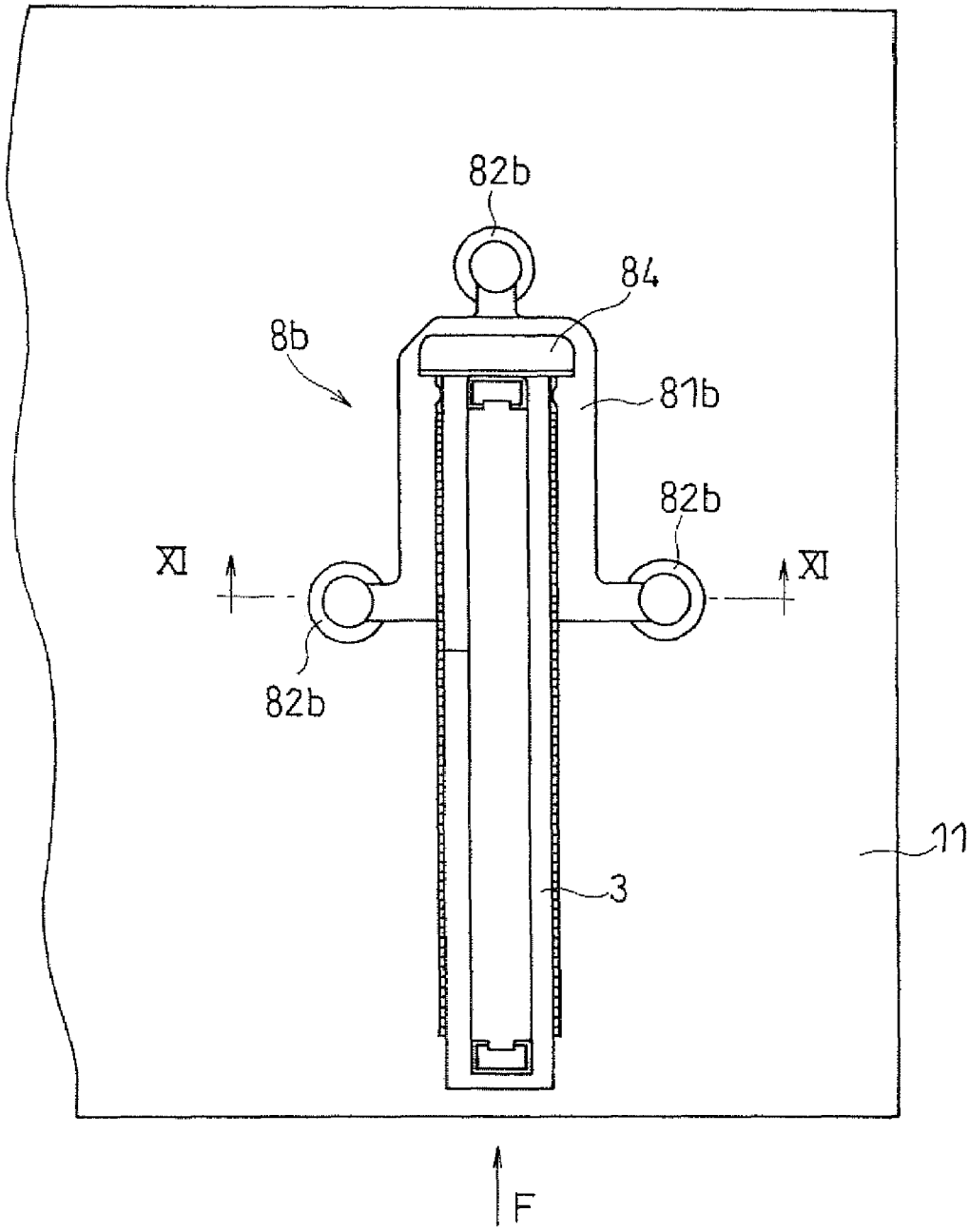
FIG. 10 is a top view illustrating the configuration of a connector reinforcement member for use in an electronic device according to a second embodiment of the present invention.

Briefly, as can be appreciated from FIG. 10, the reinforcement member 8*b* is shaped by halving the connector reinforcement member 8*a* shown in FIG. 1 in the direction perpendicular to its longitudinal direction. Specifically, the connector reinforcement member 8*b* has a frame portion 81*b*, which is obtained by halving the elongated rectangular ring-shaped frame portion 81*a*, so that the elongated rectangular ring is open at one end. The frame portion 81*b* has three spacers 82*b*, instead of the spacers 82*a*, two of which externally extend from their respective long sides at the open end, and the remaining one extend from a short side opposed to the open end. In addition, the frame portion 81*b* has a guiding portion 84 provided on the short side.

Figure 11:
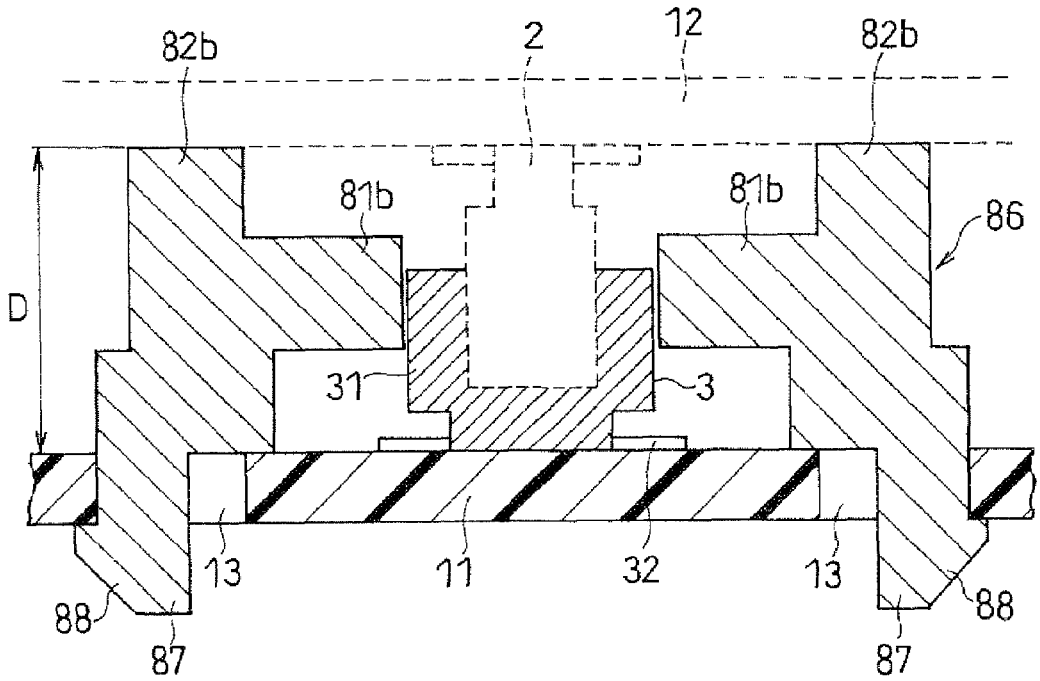
FIG. 11 is a cross-sectional view of a substantial portion taken along line XI-XI in FIG. 10.

Also, as can be seen from FIG. 11, the spacers 82*b* are each shaped by adding a snap portion 87 at the bottom side of the spacer 82*a*. Note that the spacers in FIG. 11 are schematically illustrated as in FIGS. 4 and 6. Each snap portion 87 has a slope portion 88 provided at its end. The connector reinforcement member 8*b* is attached to the female connector 3 on the first circuit board 11 by inserting each snap portion 87 into a hole 13 provided in the first circuit board 11. Concretely, when the snap portion 87 is inserted into the hole 13, its slope portion 88 is brought into contact with the first circuit board 11, so that the snap portion 87 is bent while passing through the hole 13, and attached to the circuit board 11 based on the snap-fit principle.

The connector reinforcement member 8*b* thus attached prevents distortion of the female connector 3 in contact therewith by resisting a force in the direction perpendicular to the snap portions 87 (i.e., the direction parallel to the first circuit board 11). The reinforcement member 8*b* is secured to the circuit board 11, and therefore even if an external shock or suchlike tends to cause the circuit board 12 in the above-described state shown in FIG. 8 to move in the direction F, the reinforcement member 8*b*, which is secured to the first circuit board 11 by the snap portions 87, suppresses to a significant extent a change in the positional relationship between the male connector 2 and the female connector 3. Specifically, the connector reinforcement member 8*a* takes advantage of the tension applied by the frame portion 81*a* to reinforce the strength of the housing 31 and thereby to protect the connection by the connector CO, while the connector reinforcement member 8*b* takes advantage of the mechanical strengths of the frame portion 81*b*, the snap portions 87, and the first circuit board 11 to reinforce the strength of the housing 31.

Thus, the spacer 82*b* has both the function of the spacer 82*a*, which maintains the space between the first circuit board 11 and the second circuit board 12 at a predetermined distance (D), and the function of maintaining the position of the connector reinforcement member 8*b* by resisting a force parallel to the first circuit board 11.

As described above, the reinforcement member 8*b* is secured to the circuit board 11, and therefore even if an external shock is applied, so that the unillustrated circuit board 12 tends to move in the direction F, the reinforcement member 8*b* secured to the circuit board 11 can avoid to a significant extent a change in the positional relationship between the male connector 2 and the female connector 3. In addition, the reinforcement member 8*b* is attached to the circuit boards based on the snap-fit principle, making it possible to readily attach the reinforcement member 8*b* to the circuit board 11 at low cost with a reduced number of man-hours.

Note that the reinforcement members 8*b* are each preferably provided externally of its corresponding one of the two short sides of the female connector 3. However, when the distance B shown in FIG. 7 is significantly large, and the frame 4 is highly unlikely to be brought into contact with the second circuit board 12 even if it is greatly distorted, it is possible to omit one of the reinforcement members 8*b* that is provided at the short side of the female connector 3 that is opposed to the frame 4. The same is applicable to the case where the distance C shown in FIG. 7 is significantly large. However, the reinforcement member performs its reinforcement function most effectively when it is formed in a ring shape.

In addition, the strength of the external cover 5 provided as a structural member is taken into consideration. For example, in the case where the external cover 5 is made up of a metal material, the degree of distortion caused by shock is generally lower than that in the case of being made up of a resin material, and therefore the distance between the inner wall of the external cover 5 and each end of the circuit boards within the external cover 5 can be shortened as compared to that in the case of being made up of a resin material. The same can be said of the frame 4. In the case where the frame 4 is made up of a resin material, the distance between the inner wall of the frame 4 and the end of the circuit board 12 is preferably set to be longer than that in the case of being made up of a metal material.

Third Embodiment

Figure 12:
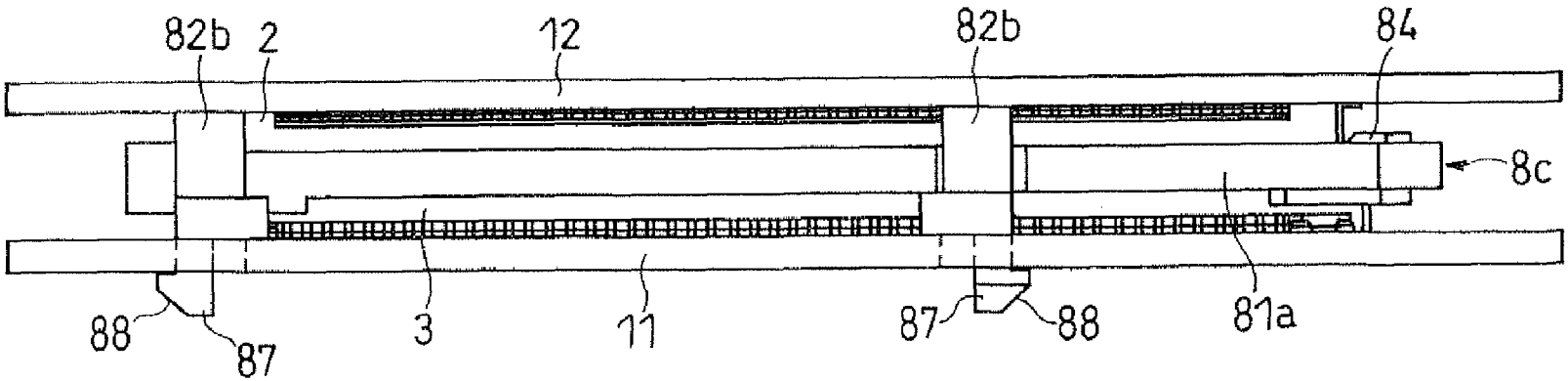
FIG. 12 is a side view illustrating the connection between two circuit boards for use in an electronic device according to a third embodiment of the present invention.
Figure 13:
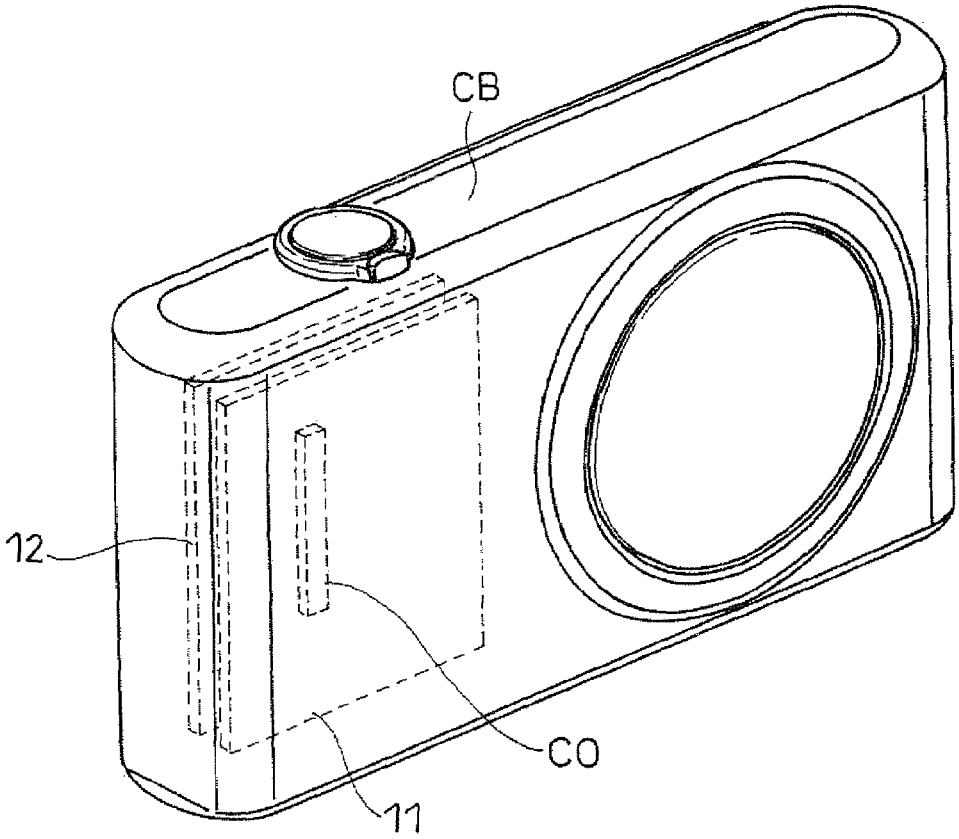
FIG. 13 PRIOR ART
FIG. 13 is a perspective view illustrating the configuration of a digital camera.

A connector reinforcement member provided in an electronic device according to a third embodiment of the present invention will be described with reference to FIG. 12. A connector reinforcement member 8*c* in the present embodiment differs from the connector reinforcement member 8*a* in the first embodiment, in that the spacers 82*a* are replaced by spacers 82*b* as included in the connector reinforcement member 8*b* in the second embodiment. Specifically, the snap portion 87 and the slope portion 88 are provided at the bottom of each spacer 82*a* as included in the connector reinforcement member 8*a*.

Therefore, the connector reinforcement member 8*c* has both the function of the connector reinforcement member 8*a* surrounding the female connector 3, and the function of the reinforcement member 8*b* secured to the circuit board 11. Thus, it is possible to achieve an advantageous effect of preventing any damage to the connectors as compared to those achieved in the first and second embodiments.

Note that the above embodiments have been described with respect to the case where the connector reinforcement members 8*a* through 8*c* are made up of a resin material, but this is not restrictive. Any other material can be used without problem, so long as its strength is at substantially the same level as the resin material, and an equivalent effect can be achieved.

The present invention is applicable to electronic devices, such as digital still cameras and digital video cameras, which have a plurality of circuit boards provided therein, but this is not restrictive. The present invention is applicable to a wide variety of electronic devices, particularly highly portable devices, such as camera-equipped cell phones, and personal digital assistants.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

The invention claimed is:

1. An electronic device having provided therein at least a first circuit board and a second circuit board, which are electrically connected together, the device comprising:

a female connector secured to the first circuit board and having an opening;

a male connector secured to the second circuit board and inserted into the opening; and a connector reinforcement member provided close to the female connector, the connector reinforcement member being brought into contact with the female connector, which is about to be distorted by an external force, thereby suppressing distortion of the female connector, wherein:

the connector reinforcement member includes alignment means placed in contact with both the first circuit board and the second circuit board to hold the first circuit board and the second circuit board so as to be respectively spaced apart at first and second predetermined distances from the connector reinforcement member.

2. The electronic device according to claim 1, wherein the connector reinforcement member is provided around the female connector.

3. The electronic device according to claim 1, wherein the first and second predetermined distances are set, such that the connector reinforcement member is out of contact with both the first circuit board and the second circuit board.

4. The electronic device according to claim 1, wherein the connector reinforcement member has a spacer for holding the first circuit board and the second circuit board so as to be spaced apart at a predetermined distance from each other.

5. A connector reinforcement structure formed by integrating together a plurality of connector reinforcement members of claim 1.

6. The electronic device according to claim 2, wherein the connector reinforcement member has an elongated rectangular ring portion roughly analogous to the opening of the female connector, and the female connector is enclosed by the elongated rectangular ring portion, which applies tension to suppress distortion of the female connector.

7. The electronic device according to claim 2, wherein the connector reinforcement member has a snap portion by which to secure the connector reinforcement member in at least one place around the female connector to the first circuit board.

8. The electronic device according to claim 4, wherein the alignment means is integrally formed with the spacer.

9. The electronic device according to claim 1, wherein the second predetermined distance is smaller than a distance between an end portion of the opening in the female connector and the second circuit board.

10. The electronic device according to claim 9, wherein the connector reinforcement member has a guiding portion provided at a surface facing the second circuit board, the guiding portion having a slope portion inclined toward the opening of the female connector.

11. The electronic device according to claim 10, wherein the guiding portion is provided so as to partially cover the end portion of the opening in the female connector with the slope portion.

12. The electronic device according to claim 11, wherein the slope portion is positioned on the end portion of the opening in the female connector.

13. The electronic device according to claim 10, wherein the guiding portion is provided in a longitudinal direction of the connector reinforcement member.

14. The electronic device according to claim 10, wherein the connector reinforcement member is provided with a plurality of the guiding portions.

* * * * *